US005414867A

United States Patent [19]

Bowling et al.

[11] Patent Number: 5,414,867

[45] Date of Patent: May 16, 1995

[54] DISPOSABLE GARMENT FOR USE IN EMERGENCY SITUATIONS

[75] Inventors: Patricia J. Bowling, Las Vegas, Nev.; Robert F. Brecher, Lompico, Calif.; Scott Burgess, Incline Village, Nev.

[73] Assignee: TCB California Inc., San Francisco, Calif.

[21] Appl. No.: 109,027

[22] Filed: Aug. 18, 1993

[51] Int. Cl.[6] ..... A41D 13/00

[52] U.S. Cl. ..... 2/51; 2/46; 2/69; 2/114; 2/912; 2/915

[58] Field of Search ..... 2/9, 10, 11, 59, 12, 2/84, 69, 69.5, 105, 106, 104, 114, 202, 206, 207, 912, 913, 914, 915, 916, 917, 918, 919, 275; 24/442, 306; 128/857, 863, 202.19, 206.19, DIG. 15

[56] References Cited

U.S. PATENT DOCUMENTS

| | | | |
|---|---|---|---|
| 969,491 | 9/1910 | Payne . | |
| 986,728 | 3/1911 | Lee et al. . | |
| 1,560,997 | 11/1925 | Kelly . | |
| 2,374,643 | 5/1945 | Boettcher . | |
| 2,492,003 | 12/1949 | Peckinpaugh . | |
| 2,668,294 | 2/1954 | Gilpin | 2/76 X |
| 2,752,916 | 7/1956 | Haliczer | 128/206.19 |
| 2,987,730 | 6/1961 | Walker . | |
| 3,045,815 | 7/1962 | Abildgaard . | |
| 3,098,233 | 7/1963 | Hoagland . | |
| 3,349,285 | 10/1967 | Belkin | 2/114 X |
| 3,736,595 | 6/1973 | Siegmann | 2/2 |
| 3,823,418 | 7/1974 | Piper | 2/206 |
| 3,868,728 | 3/1975 | Krzewinski | 2/114 |
| 3,977,025 | 8/1976 | Horan | 2/114 |
| 4,016,604 | 4/1977 | Welke | 2/913 X |
| 4,106,120 | 8/1978 | Zurbrigg et al. | 2/913 X |
| 4,113,911 | 9/1978 | LaFitte et al. | 428/284 |
| 4,214,320 | 7/1980 | Belkin | 2/114 |
| 4,290,148 | 9/1981 | Roberts | 2/51 |
| 4,370,782 | 2/1983 | Aronica | 24/198 |
| 4,395,782 | 8/1983 | Reynolds | 2/114 |
| 4,524,463 | 6/1985 | Ogden | 2/105 |
| 4,569,086 | 2/1986 | Takefman | 2/49 |
| 4,637,075 | 1/1987 | Ingrisano et al. | 2/94 |
| 4,718,124 | 1/1988 | Sawicki et al. | 2/114 |
| 4,766,608 | 8/1988 | Cusick et al. | 2/2 |
| 4,845,779 | 7/1989 | Wheeler et al. | 2/84 |
| 5,033,115 | 7/1991 | Bowling | 2/51 |
| 5,107,547 | 4/1992 | Scheu | 128/206.19 |

FOREIGN PATENT DOCUMENTS

| | | | |
|---|---|---|---|
| 1144-702 | 4/1983 | Canada | 2/72 |
| 2189979 | 11/1987 | United Kingdom | A41D 13/04 |

OTHER PUBLICATIONS

*Journal of Emergency Medical Services* "Inroads" by Doug Wolfberg, Dec. 1992, pp. 64–65 & 68.

*Journal of Emergency Medical Services Buyers' Guide 1993 Edition* Sep. 1992, vol. 17, No. 9.

Press Release "Trauma Suit TM Protective Gown Materials Safeguard Healthcare Workers from HIV & Hepatitis B Viruses".

*Primary Examiner*—Jeanette E. Chapman

*Attorney, Agent, or Firm*—Townsend & Townsend Khourie & Crew

[57] ABSTRACT

The invention relates to a disposable protective garment for protecting personnel when caring for potentially infectious victims in an emergency situation. The garment is adapted to be readily donned by the user and is provided with strategically located fastener means to provide for quick and substantial closure of the garment about the user. Specially connected gloves and detachable masks are also provided for use with the protective garment.

17 Claims, 4 Drawing Sheets

DISPOSABLE GARMENT FOR USE IN EMERGENCY SITUATIONS

FIELD OF THE INVENTION

The invention relates to a disposable protective garment for protecting personnel when caring for potentially infectious victims in an emergency situation. The garment is adapted to be readily donned by the user and is provided with strategically located fastener means to provide for quick and secure closure of the garment about the user. Specially connected gloves and detachable masks are also provided for use with the protective garment.

PRIOR ART

Heretofore, hospital gowns were typically designed for one of two uses—either as a sterile gown for use in the operating room or as a non-sterile patient gown. These gowns, especially the sterile surgical gowns, which are worn with face masks and gloves, are worn by physicians and nurses for the protection of the patient, to avoid infecting the patient with any germs the physicians or nurses may be carrying or with germs from another patient. The gowns are maintained sterile and are donned with the aid of other medical personnel in such a way as to maintain a "sterile field" around the patient in the operating room. The ties of such gowns typically extend around the waist of the wearer and are attached at the front or rear by either a sterile or non-sterile assistant. The function of sterile gowns is thus to prevent cross-contamination from patient to patient or from medical personnel to patient. Typical sterile gowns and the manner of using them are described, for example in Aronica, U.S. Pat. No. 4,370,782 and in Reynolds, U.S. Pat. No. 4,395,782. Such gowns are typically made of a disposable non-woven fabric such as the material described in LaFitte et al., U.S. Pat. No. 4,113,911.

In the operating room, medical personnel also don sterile gloves and masks for the same purposes as the gowns. The gloves are typically made of latex or natural rubber. They are put on, after gowning, either by a closed gloving technique or with assistance from another member of the sterile team. The masks are typically made of a non-woven filter material. They are typically not formed to the wearer's face, and they are pleated to prevent them from becoming saturated with moisture from the wearer's breath and being drawn into the wearer's mouth. The masks are held by ties behind the wearer's head. Masks are non-sterile items and must be donned prior to gowning with the sterile gown. In a non-sterile setting, the gloves and mask are put on at the wearer's leisure. After an operation, the gowns, gloves, and masks are removed and disposed of before bacteria from the patient can be transferred to other patients directly or indirectly.

Emergency personnel frequently do not use gowns of any sort, because of the time required for donning and removing gowns, and because in a trauma situation the patient is not in a sterile field where contamination of the patient by the attending personnel is the primary consideration. With the rapid increase of highly infectious diseases, such as AIDS and hepatitis, the medical profession has become increasingly concerned not only with protecting the patient, but in protecting the health care provider from a patient's infectious disease. This is especially true in emergency situations either in the emergency room of a hospital or at the site of an accident where it is unknown if the patient has a communicable infectious disease. In such a situation a gown or garment is required with adequately protects the health care provider and which can be donned quickly and easily, permitting the health care provider to give prompt attention to the patient.

The problem of providing protective gowns for emergency workers was recognized and described by the inventors of this application in their earlier U.S. Pat. No. 5,033,115 which issued Jul. 23, 1991. In the patent a protective garment is provided which includes a standard surgical type gown having sleeves and a neck portion, and having a face mask attached to the neck portion of the gown and gloves attached to its sleeves. This arrangement permits the gown, including the face mask and gloves, to be folded and stored as a unit, permits it to be donned rapidly without assistance, and provides substantial protection for the wearer. The gown body is preferably a standard surgical gown made of a material which resists absorption of liquid. Such a gown is open down its back, so that the back side of the gown includes two substantially vertical edges which may meet or overlap in the middle of the back.

The face mask of the prior art gown includes two sections: a flexible protective covering which is permanently attached to the neck portion of the gown and extends to the bridge of the wearer's nose, and a protective eye shield which is attached to the surgical mask at the bridge of the nose. The flexible covering may be a single unit, or it may be made of separate neck covering and surgical mask. The eye shield preferably has a head band or some other equivalent means of supporting the full face mask such that it will not fall off during the giving of medical attention by the wearer.

The gown is provided with a shoulder tab which is permanently attached to the right front shoulder of the garment and has a free end, which is detachably secured by hook and pile pressure fastener means to the right front of the gown, and which, when detached for donning, comes in front of the wearer's face, behind his head and over the right shoulder to be detachably secured to the front right side of the gown. The shoulder tab closure enables rapid donning and removal of the gown and securely closes the gown.

The gown has a waist tab which is permanently secured to one side of the garment and has a free end which the wearer extends around the back at waist level to be secured on the opposite front side so as to hold the garment closed at a second point. The sleeves of the gown have gloves attached to them by means of an adhesive seal. This arrangement not only makes the gown and gloves easier and faster to don, but it also creates a seal between the gloves and sleeves to prevent foreign substances from entering the sleeves and coming into contact with the wearer's skin.

There is still need however for a protective type garment for use in emergency situations which is quickly and readily secured about the user and which is useful in adverse conditions such as high wind or close quarters and which has masks disconnectedly connected thereto for use when needed as well as an improved connection of the gloves to the garment.

SUMMARY OF THE INVENTION

The present invention provides a protective garment designed to protect personnel when treating potentially infectious patients in emergency situations. The garment has an open black and is adapted to be quickly donned and to be securely fastened around the user. The garment comprises a body including a front portion having sleeves and a first side flap portion and a second side flap portion defining an open back of the garment. First pressure fastener means are attached to the first side flap portion. Second pressure fastener means are located on the second side flap portion positioned to contact and connect with the first pressure fastener means when the side flap portions are overlapped and pressed together to hold the garment securely around a wearer. Shoulder tab means have one end permanently secured to one of the flap portions and a free end initially detachably secured to the front portion of the body when the garments is in an open position such that a wearer can easily don the garment from the back. Attachment means are provided on the front portion of the body such that the wearer can with one hand, in one motion, quickly detach the free end from front portion of the garment and then pull the tab means behind and around the head and secure the free end to the attachment means so that the garment will remain closed during use. In preferred form the protective garment includes a belt which has one end permanently secured at waist level to the same side flap portion to which the tab means is permanently secured. The free end of the belt is also initially detachably secured with the shoulder tab means to the front portion of said body. The wearer also detaches the free end of the belt and brings it around the head and secures the free end to the front portion of the garment so as to create a closure around the waist of the wearer. When the first and second pressure fasteners means on the side flap portions are connected when the side flap portions are overlapped and the shoulder tab and the belt are also connected the garment is securely held on the user even in high wind condition.

In a particular aspect the invention provides a protective type garment having an open back formed of a body portion including a front portion and first and second oppositely located side flap portions adapted to be closed around the body of a user. The protective garment is provided with sleeves and a collar portion and it is adapted to be entered from behind by inserting the arms of the user into the sleeves. A shoulder tab of sufficient length is extendable around the neck of the user and is long enough to reach the mid section of the front portion of the garment. The shoulder tab has one end fixedly secured to the upper end of the first of the side flap portions of the garment adjacent the neck portion. The other end of the shoulder tab has a first pressure fastener element on one side thereof and a second pressure fastener on the other side thereof. A first vertically extending pressure fastener is located on the exterior of the front portion of the garment for attaching the second pressure fastener of the shoulder tab thereto to assist in securing the garment on the user.

The garment is adapted to be quickly and securely fastened around the user. Thus, a second vertically extending pressure fastener is attached to the inside upper portion of the first of the side flap portions of the garment adjacent the shoulder tab. A first horizontally extending pressure fastener is attached to the outside upper portion of the second side flap portion of the garment in a position to be connectable with the second vertically extending pressure fastener to assist in closing the side flap portions when they are overlapped and to thus securely fasten the garment around the user. A third vertically extending pressure fastener is attached to the inside of the first of the side flap portions of the garment at the waist level thereof. A second horizontally extending pressure fastener is attached to the exterior of the second side flap portion of the garment adjacent the waist level thereof in a position to be connectable with the third vertically extending pressure fastener to assist in closing side flap portions of the garment securely around the waist of the user. A belt is permanently attached to one of the side flap portions at waist level and has a free end for extending around the waist of the user. A belt attachment pressure fastener is connected to the front portion of the body of the garment for attaching the free end of the belt.

Face shield pressure fastener means are positioned on the outside of the front portion of the garment below the collar portion thereof. A face shield having pressure fastener means is connectable with the face shield fastener means for connection to the front portion of the garment. A particle shield pressure fastener means is located on the inside of the front portion of the garment below the collar portion thereof. A particle shield is disconnectably connected to the particle shield pressure fastener. A glove is connected to the end of each of the sleeves by means of overlapping stitches. Preferably there are seven to nine overlapping stitches per inch of material used to connect the gloves to the sleeves.

OBJECT OF THE INVENTION

It is a particular object of the present invention to provide a protective garment for emergency use which is readily donned by the user and is capable of being quickly and securely fastened by the user around the body. Another object of the present invention is to provide an emergency protective garment which has disconnectably connected face and mouth shields attached thereto and gloves which are connected to the sleeves of the garment. Further objects and advantages of the garment of the present invention will become apparent from the following detailed description read in view of the accompanying drawings which are made a part of this specification.

DETAILED DESCRIPTION OF THE INVENTION

The present invention is directed to a protective garment for use by emergency personnel. The garment is readily donned by the user and is capable of being quickly and securely fastened by the user about his person. A disconnectably connected face shield and a mouth shield are located on the garment in readily accessible positions. Specially connected gloves are provided for protection of the user's hands. The gloves are connected so as to facilitate entry and exit of the user's hands.

Figure 1:
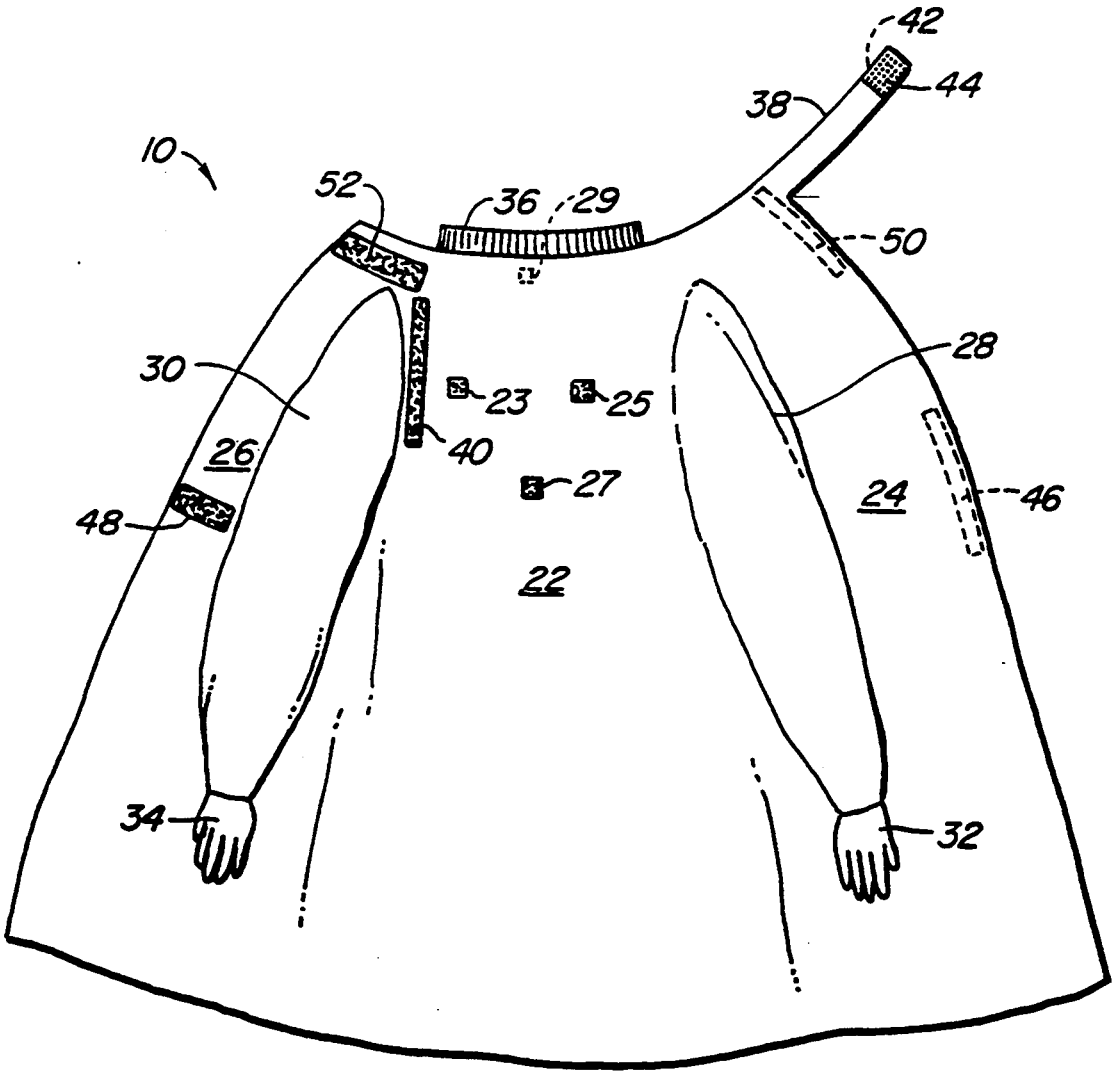
FIG. 1 is a front elevation view of one embodiment of a protective garment of the present inventions spread out to better illustrate its construction.

Refer now to FIG. 1 which is a front elevation view of one protective garment of the present invention spread out to better illustrate its construction. The disposable protective garment of the invention is indicated generally by the number 10. The garment has an open back and includes a front portion indicated generally by 22, a first side flap portion indicated generally by 24 and a second side flap portion indicated generally by 26. The garment is shaped and cut in a style similar to the protective surgical gowns heretofore used by hospital personnel. A sleeve 28 is located between the front portion 22 and the first side portion 24. A similar sleeve 30 is connected to the other side of the garment. Gloves 32 and 34 are connected to the end of sleeves 28 and 30 respectively. A collar 36 is connected across the top of the front portion 22 to form the collar portion of the garment.

The garment 10 is adapted to be put on from the back. It comes folded in such a way, known in the medical field, that the arm holes of the sleeves 28, 30 are neatly exposed, covered generally by only one fold, in the back side of the package. Initially the free end of the shoulder tab means 38 is detachably secured to the front portion 22 of the body garment 10. (See FIG. 9) The user slides his hands under the fold, puts his hands through the sleeves 28, 30 and into the gloves 32, 34, at the same time placing the garment 10 over the shoulders. Once the user has the garment 10 over his shoulders and his arms at least partly through the sleeves 28, 30, he takes the shoulder tab 38, detaches it from the front of the gown, to which it is secured by means of a hook-and-pile pressure fastener 44, and in one motion, brings it over the opposite shoulder, and around the back of the head, and secures it to the front of the gown, again by means of a hook-and-pile pressure fastener 42 located on the inside of the shoulder tab 38 connecting it to pressure fastener 40 located on the outside of the front portion of the garment 10. The user secures the waist of the garment by taking hold of the first side flap portion 24 which has a vertically extending pressure fastener 46 on the inside of the garment and folds the side flap portion around his back and secures it to the opposite side flap portion by means of a horizontally extending hook-and-pile pressure fastener means 48 on the outside of the flap portion of the garment. The upper collar portion of the protective garment is secured by means of a vertically extending pressure fastener 50 which is fixedly secured to the inside of the first side flap portion 24 of the garment 10 being connected by the user to a horizontally extending pressure fastener 52 which is disposed on the outside of the second side flap portion 26 of the protective garment.

Means are provided on the outside of the front portion 22 of the garment 10 for disconnectably connecting a face shield thereto. It has been found that it is particularly advantageous to have a face shield in a readily accessible position on the front of the protective garment so that may it be quickly detached for use at the option of the wearer. It is also preferred to have a face shield for optional use by the wearer that may be fitted easily and quickly over the head of the user even if glasses are being worn. Thus, pressure fastener means, such as pressure fasteners 23, 25 and 27, are provided on the outside of the front portion 22 of the body of the garment 10 to provide for disconnectably connecting the face shield thereto.

Figure 1A:
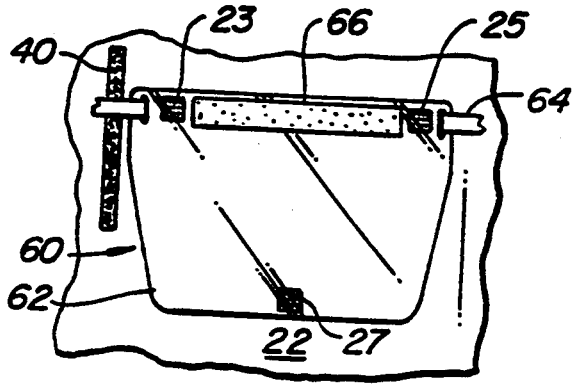
FIG. 1*a* is a partial elevation view showing the location and manner of connecting a face shield to the protective garment of the present invention.

A preferred face shield indicated generally by the number 60 disconnectably connected to the front of the garment 10 is illustrated in FIG. 1*a*. The face shield 60 has attached thereto pressure fasteners designed to mate with the pressure fasteners 23, 25, 27 located on the front portion 22 of the protective garment. The face shield includes a clear shield 62 and a suitable elastic headstrap 64 for securing the face shield to the head of the user. A sweat band 66 may be included in the face shield.

Figure 1B:
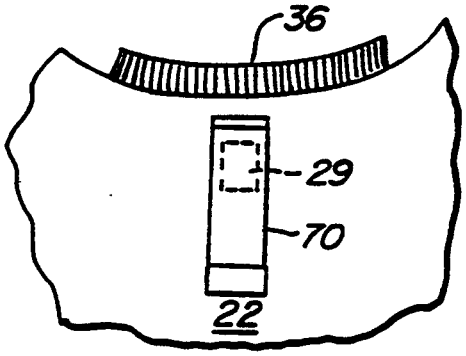
FIG. 1*b* is a partial elevation view showing the location and manner of connecting a particle mask to the inside of the protective garment of the present invention.
Figure 2:
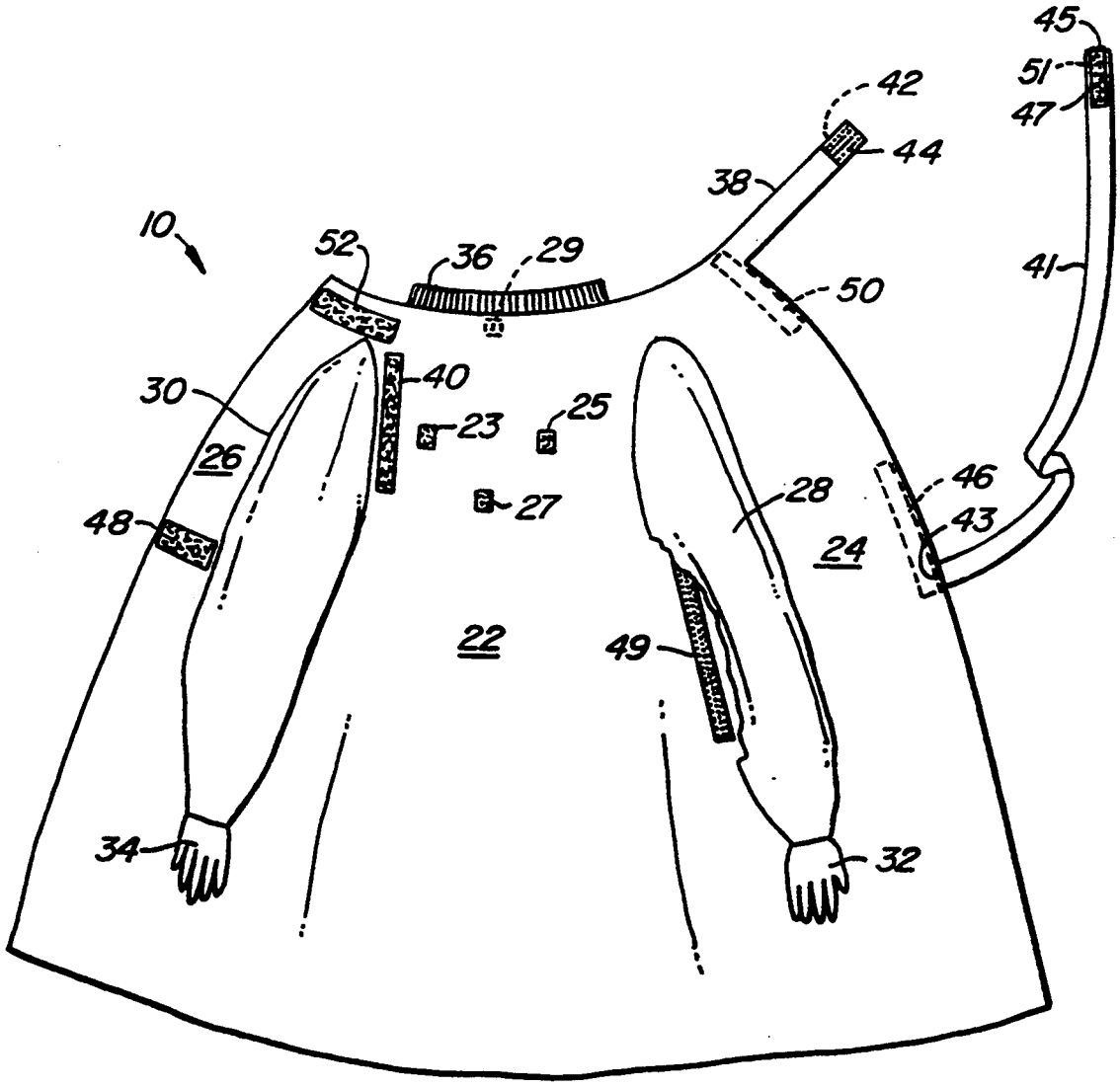
FIG. 2 is a front elevation view of the preferred embodiment of a protective garment in accordance with the present invention spread out to better illustrate its construction.
Figure 3:
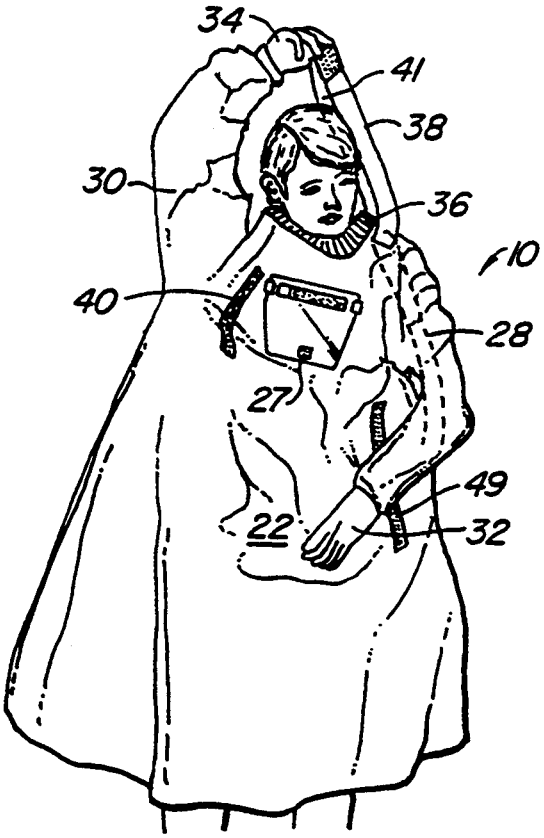
FIG. 3 is an elevation view in perspective showing a user donning the garment and beginning to secure the garment about his body.
Figure 4:
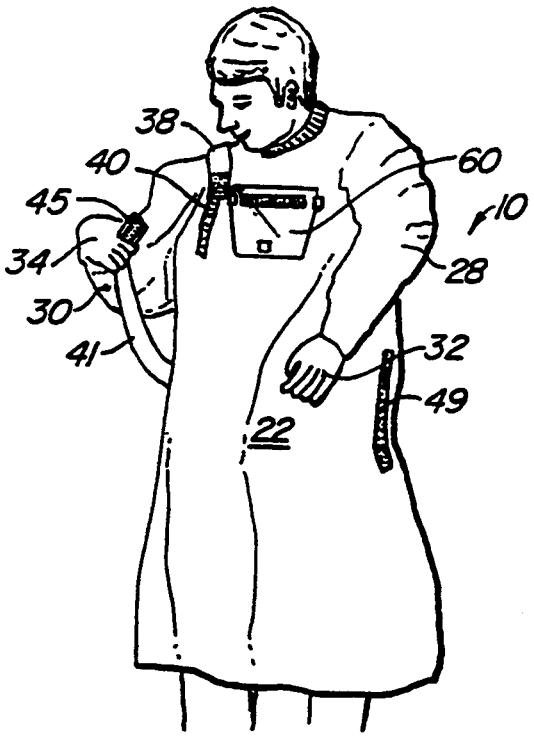
FIG. 4 is an elevation view in perspective showing the user securing the garment around his body.
Figure 5:
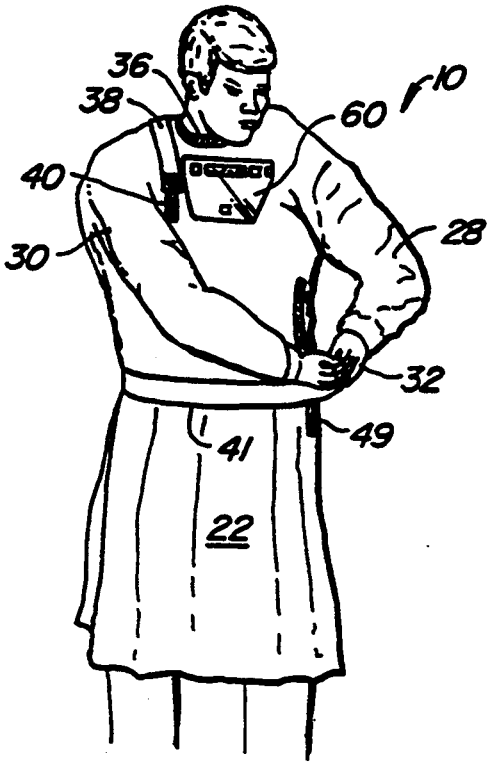
FIG. 5 is an elevation view in perspective showing the user attaching the belt around his waist.
Figure 6:
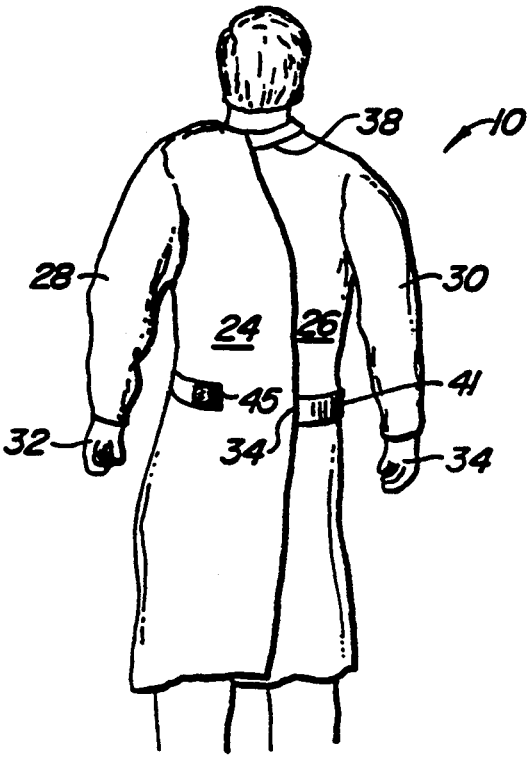
FIG. 6 is a rear elevation view in perspective showing the garment fully closed about the user.

A particulate shield mask 70 is disconnectably connected to the inside of the front portion 22 of the garment just below the collar 36 as shown in FIG. 1*b*. The particle mask 70 preferably is a conventional particle mask used by hospital personnel and may be directly attached to pressure fastener 29 located on the interior of the garment just below the collar 36. The particle mask 70 is therefore readily and safely accessible to the use if needed after donning the garment.

FIGS. 2–6 shows the preferred embodiment of the protective garment of the present invention. The preferred embodiment includes many of the elements of the embodiment described and shown in FIG. 1, FIG. 1*a* and FIG. 1*b* and similar elements will use the same numbers. The preferred embodiment includes a belt 41 having one end 43 permanently secured at waist level to the side flap portion 24 to which the free end of the shoulder tab 38 is permanently attached. The free end 45 of the belt has pressure fasteners 47, 51 on both sides and is long enough to encircle the waist of the user. Typically the belt is made from a material such as TYVEK QC type material. A belt two inches wide and thirty six inches long has been found useful in accordance with the invention. The belt is sewn to the side flap portion 34 (preferably the left flap) of the body of the garment. It has been found that the belt should be sewed to the side flap portion about twenty four inches or so down from the top of the garment to be at waist level from most users. A pressure fastener 49 is located on the body of the garment 10 in position for use to secure the free end 45 of the belt around the user. The pressure fastener 49, which is preferably a velcro strip, is placed transversely on the body of the garment as shown to allow for maximizing the length and adjustability of the belt.

As illustrated in FIGS. 3–6 the free end 45 of the belt is initially attached to the top pressure fastener 44 of the shoulder tab 38. That is the velcro strip 44 of the shoulder tab 38 pressed against the velcro strip 40 on the garment. Velcro strip 47 is pressed against velcro strip 42 to connect the end of the belt to the shoulder tab. When the user dons the gown and removes the shoulder tab 38 from the front portion 22 they will simultaneously be removing the belt 41. There is no looking for the belt—its already in your hand.

After the user has put on the sleeves and gloves, they remove the tab means 38 and belt free end 45 end with their right hand. In one motion the ends are removed from the pressure fastener 40, on the front portion of the garment and circled behind the head, and the shoulder tab 38 is secured to pressure fastener 40 on the right front portion adjacent the chest of the user thus securing the top of the garment. The belt 41 is then removed from the shoulder tab 38 and pulled around the waist, and secured to the pressure fastener 49 which is at waist level on the garment. Fastener 49 is placed along the vertical arm seam—i.e. under the armpit of the body of the garment. The garment is then fully secured.

The pressure fastener 47 on the end 45 on the belt 41 is of a lesser strength than the pressure fastener 44 of the shoulder tab 38. This is to insure that the shoulder tab attachment stays in place on pressure fastener 40 when the belt is removed and extended. The strength of the connection between the pressure fastener 47 and pressure fastener 42 should be from 30% to 70% less than the strength of the connection formed by pressure fastener 42 and pressure fastener 40 which holds the shoulder tab 38 to the front of the garment to insure that this connection is not broken when the belt is removed. Preferably strength of the belt-shoulder tab should be between 40 to 60 percent of the strength of the shoulder tab-garment connection. A strength of fifty percent has been found to be most suitable.

Figure 7:
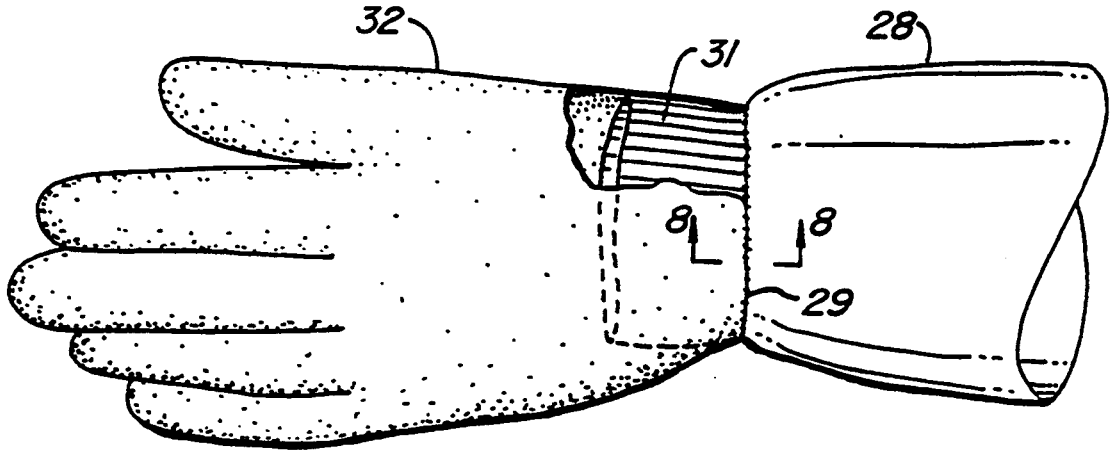
FIG. 7 is an enlarged perspective view of the preferred glove and sleeve arrangement in accordance with the present invention.
Figure 8:
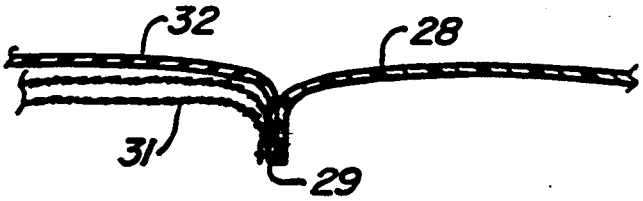
FIG. 8 is a sectional view taken at line 8—8 of FIG. 7.

FIG. 7 is a perspective view of a glove connected to a sleeve of the protective garment 10 in accordance with the preferred embodiment of the present invention. FIG. 8 is a sectional view of FIG. 7 taken at line 8—8. The latex glove 32 is fixedly attached to the sleeve 28 by means of over lock stitch 29 done on a conventional over lock machine. A cuff portion 31 is also connected by this stitching and serves to insure that the sleeve 28 and the latex glove 32 fit comfortably around the wrist of the wearer.

The sleeve portion is preferably formed of a soft, non-absorbent polyester tubular material which insures a comfortable close fit around the wrist. The tubular cuff is doubled over and is attached to the sleeve 28 at the seam which also attaches the glove 32 to the sleeve. The sleeve is turned inside out and the upper end of the glove is positioned against the outside of the sleeve. The cuff is then inserted into the glove and aligned with the sleeve and the upper end of the glove. The sleeve 28 is bunched to fit about the glove 32 to allow for expansion when the glove and the sleeve are stretched when the user enters and exits the gloves. In accordance with the invention, the seam connecting the sleeve, the glove and the cuff is formed by over lock stitching. The stitches go around the material and form an over lock. It has been found that between 7 and 9 stitches per inch give the best results. Eight stitches per inch are optimum to form this seam. Substantial efforts were expended to determine this optimal mix between the number and type of stitches for tear resistance of the glove and impermeability of the seam to undesirable body fluids.

Figure 9:
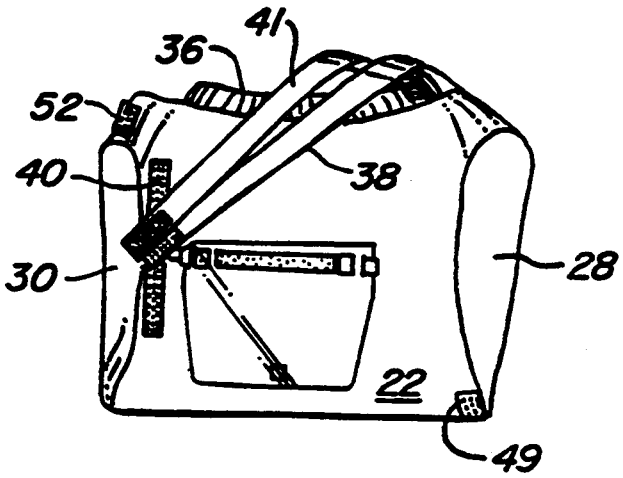
FIG. 9 is a view illustrating the garment folded in a package ready for use.

The present invention provides a protective garment for use by people, especially in emergencies, who are involved in treating people where body fluids may present a problem of infection. The garment of the invention is packed as shown in FIG. 9 ready to be donned by the user quickly and easily. Further the garment is adapted to be secured by the user on his person by a combination of securing means. The combination of securing means adapts the garment for use in adverse conditions such as high wind.

The principles, preferred embodiments and modes or operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, all such variations and changes, which fall within the spirit and scope of the present invention as defined in the following claims, are expressed intended to be embraced thereby.

What is claimed is:

1. A protective garment designed to protect a user when treating potentially infectious patients in emergency situations, said garment comprising a body including a front portion having sleeves and a first side flap portion and a second side flap portion defining an open back of the garment, first pressure fastener means on said first side flap portion, second pressure fastener means on said second side flap portion located to contact and connect with said first pressure fastener means when the side flap portions are overlapped and pressed together to hold said garment around the user, tab means having one end permanently secured to one of said flap portions and a free end initially detachably secured to the front portion of the body in an open position such that a user can don the garment from the back, attachment means on said body such that the user can with one hand, in one motion, quickly detach said free end of said tab means from said body, pull said tab means behind and around the head and secure said free end to said attachment means so that the garment will remain closed during use, a belt attachment means on said body; and a belt permanently secured at waist level to the same side flap portion to which said tab means is permanently secured, said belt having a free end also initially detachably secured with said tab means to the front portion of said body such that the user can detach the free end of said belt from said body and bring it around the head and secure the free end to said belt attachment means so as to create a closure around the waist of the wearer.

2. The garment of claim 1 in which the said first pressure fastener means include a pressure fastener at both waist level and collar level of said first side flap portion and that said second pressure fastener means includes a corresponding pressure fastener at both waist level and collar level of said second side flap portion.

3. The garment of claim 1 in which the said first pressure fastener means include a pressure fastener at both waist level and collar level of said first side flap portion and that said second pressure fastener means includes a corresponding pressure fastener at both waist level and collar level of said second side flap portion.

4. The garment of claim 3 in which the free end of said belt is initially detachably secured by pressure fastener means to the free end of said tab means.

5. The garment of claim 4 in which the pressure fastener means connecting the belt to the tab means is weaker than the attachment means connecting the tab means to said body.

6. An emergency protective garment designed to protect emergency personnel when treating potentially infectious patients in emergency situations, said garment comprising a body including a front portion having sleeves and a first side flap portion having an inside and outside and a second side flap portion having an inside and an outside, the flap portions defining an open back of the garment, first pressure fastener means on the inside of said first side flap portion, second pressure fastener means on the outside of said second side flap portion located to contact and connect with said first pressure fastener means when the side flap portions are overlapped and pressed together to hold said garment around a user, tab means having one end permanently secured to said first flap portion and a free end initially detachably secured to the front portion of the body in an open position such that a user can don the garment from the back, attachment means on the front portion of said body such that the user can with one hand, in one motion, quickly detach said free end from said front portion, pull said tab means behind and around the head and secure said free end to said attachment means so that the garment will remain closed during use; and a belt permanently secured at waist level to the same side flap portion to which the tab means is permanently secured, said belt having a free end initially detachably secured to said tab means when said tab means is detachably secured, such that the user can detach the free ends of said tab means and said belt and bring both around the head and secure the free ends to the front portion of the garment so as to create a closure both around the collar and the waist of the user.

7. The garment of claim 6 in which the said first pressure fastener means include a pressure fastener, at waist level and at collar level and that said second pressure fastener means includes a corresponding pressure fastener means at waist level and at collar level of the garment.

8. The garment of claim 6 in which the said first pressure fastener means include a pressure fastener, at waist level and at collar level and that said second pressure fastener means includes a corresponding pressure fastener means at waist level and at collar level of the garment.

9. The garment of claim 6 in which the means initially detachably securing said free end of said belt to said tab means is weaker than the attachment means securing said tab means to the front portion of said body.

10. The garment of claim 6 where latex gloves are sewn into the sleeves of the garment by means of seven to nine over lock stitches per inch.

11. A disposable protective garment for protecting personnel when caring for potentially infectious people in an emergency situation comprising a garment body having an open back, said garment including a front portion having an exterior and first and second oppositely located side flap portions adapted to be closed around the body of a user, said second side flap portion including an outside upper portion said garment body having sleeves and a collar portion and adapted to be entered from behind by inserting the arms of the user into the sleeves; a shoulder tab of sufficient length to extend around the neck of the user and to reach the mid section of said front portion of said garment, said shoulder tab having one end permanently secured to the upper end of the first of said side flap portions of said garment body adjacent the neck portion and the other end having a first pressure fastener element on one side thereof and a second pressure fastener on the other side thereof, a first vertically extending pressure fastener on the exterior of the front portion of said garment for attaching the second pressure fastener of the shoulder tab thereto; a second vertically extending pressure fastener attached to the inside upper portion of the first of said side flap portions of said garment adjacent the shoulder tab; a first horizontally extending pressure fastener attached to the outside upper portion of the second side flap portion of said garment in a position to be connectable with said second vertically extending pressure fasteners to assist in closing said garment body around the user; a third vertically extending pressure fastener attached to the inside of said first of said side flap portions of said garment body at the waist level portion thereof; a second horizontally extending pressure fastener attached to the exterior of said second side flap portion of said garment adjacent the waist level thereof in a position to be connectable with said third vertically extending pressure fastener to assist in closing said garment body around the user; a belt having one end permanently secured to the first of said side flap portions of said garment body at waist level thereof; a free end for encircling around a user and belt pressure fastener means on the outside of the front portion of said garment body for attaching the free end of said belt thereto to further assist in closing said garment body around the user; face shield pressure fastener means connected on the outside of said front portion of said garment body below the collar portion thereof; a face shield having pressure fastener means connectable with said face shield fastener means connected to said front portion of said garment body; particle shield pressure fastener means on the inside of said front portion of said garment body below the collar portion thereof; a particle shield disconnectably connected to said particle shield pressure fastener and a glove connected to the end of each of said sleeves.

12. The disposable protective garment of claim 11 further characterized in that the gloves are latex gloves sewn onto the sleeves of the garment.

13. The disposable protective garment of claim 12 further characterized in that the gloves are sewn onto the sleeves by means of over lock stitches.

14. The disposable protective garment of claim 13 further characterized in that there are seven to nine over lock stitches per inch used to connect the gloves to the sleeves.

15. An emergency protective garment designed to protect emergency personnel when treating potentially infectious patients in emergency situations, said garment comprising a body including a front portion having sleeves and a first side flap portion and a second side flap portion defining an open back of the garment; first pressure fastener means on the inside of said first side flap portion, second pressure fastener means on the outside of said second side flap portion located to contact and connect with said first pressure fastener means when the side flap portions are overlapped and pressed together to hold said garment around a user; tab means having one end permanently secured to said first flap portion and a free end initially detachably secured to the front portion of the body in an open position such that a user can don the garment from the back; attachment means on the front portion of said body such that the user can with one hand, in one motion, quickly detach said free end from said front portion, pull said tab means behind and around the head and secure said free end to said attachment means so that the garment will remain closed during use; belt having one end permanently secured to the first of said side flap portions of said garment body at waist level thereof and a free end for encircling around a user; belt pressure fastener means on the outside of the front portion of said garment body for attaching the free end of said belt thereto to further assist in closing said garment body around the user; face shield pressure fastener means connected on the outside of said front portion of said garment body below the collar portion thereof; a face shield having pressure fastener means connectable with said face shield fastener means connected to said front portion of said garment body; particle shield pressure fastener means on the inside of said front portion of said garment body below the collar portion thereof; a particle shield disconnectably connected to said particle shield pressure fastener and a glove connected to the end of each of said sleeves.

16. The disposable protective garment of claim 15 further characterized in that the gloves are latex gloves sewn onto the sleeves of the garment.

17. The disposable protective garment of claim 16 further characterized in that the gloves are sewn onto the sleeves by means of over lock stitches.

* * * * *